United States Patent [19]

Leibundgut

[11] 4,118,615

[45] Oct. 3, 1978

[54] HAND-ACTUATED, MULTIPLE-FUNCTION SWITCH UNIT, PARTICULARLY FOR ELECTRICAL HAND TOLLS, APPLIANCES AND THE LIKE

[75] Inventor: Gottfried Leibundgut, Solothurn, Switzerland

[73] Assignee: Robert Bosch GmbH, Stuttgart, Germany

[21] Appl. No.: 802,651

[22] Filed: Jun. 2, 1977

[30] Foreign Application Priority Data

Jul. 2, 1976 [DE] Fed. Rep. of Germany ..... 2629723

[51] Int. Cl.[2] ..... H01H 13/08; H01H 21/04; H01H 15/04; H01H 9/02

[52] U.S. Cl. ..... 200/157; 200/303; 200/293

[58] Field of Search ..... 200/157, 293, 303

[56] References Cited

U.S. PATENT DOCUMENTS

| | | | |
|---|---|---|---|
| 2,487,011 | 11/1949 | Wilhide | 200/157 |
| 2,869,043 | 1/1959 | Locher | 200/293 X |
| 2,921,147 | 1/1960 | Hutt | 200/303 X |
| 3,761,663 | 9/1973 | Brown | 200/157 |
| 4,045,637 | 8/1977 | Mongeau | 200/303 |
| 4,057,520 | 11/1977 | Schwartz | 200/303 X |

*Primary Examiner*—Davis T. Moorhead
*Attorney, Agent, or Firm*—Flynn & Frishauf

[57] ABSTRACT

To provide for simple assembly of a multiple-function switch unit in modular form to provide (a) a basic ON-OFF function and, selectively, at least one of the functions (b) speed control; (c) overload protection; (d) forward-reverse; (e) RF interference suppression, a basic housing unit is provided in which the ON-OFF switch is enclosed, and operating control units having the respectively selected functions are provided, the switch housing unit and the operating control units being respectively formed with interengaging projection-and-recess arrangements, typically dovetail joints, to assemble and secure the separate control units to the basic switch housing and to attach these units to the switch housing and to each other.

23 Claims, 5 Drawing Figures

HAND-ACTUATED, MULTIPLE-FUNCTION SWITCH UNIT, PARTICULARLY FOR ELECTRICAL HAND TOLLS, APPLIANCES AND THE LIKE

CROSS-REFERENCE TO RELATED APPLICATION

U.S. Ser. No. 802,712, filed June 2, 1977, Leibundgut assigned to the assignee of the present application.

The present invention relates to a hand-actuated switch unit which provides a basic ON-OFF function and, selectively, multiple other functions, for example speed control, overload protection which may be combined with a cut-out reset, forward or reverse rotation control, radio frequency (RF) interference suppression, or the like. The speed control may be in steps or ranges, or continuously variable.

BACKGROUND OF THE INVENTION AND PRIOR ART

It has previously been proposed to control hand tools, appliances and the like, in accordance with various desired operating functions. Basically, a main ON-OFF switch is provided and additional control functions are usually obtained by associating with the basic switch a further control housing which is connected to the switch by a screw connection, welding, or the like. It is also known to incorporate continuous speed control with an ON-OFF switch. It has also been proposed to connect RF suppression capacitors to such switches, for example by means of a spring biassed clip. The capacitor is usually separately secured in the housing of the tool or appliance. Various additional control elements may be associated with the tool or appliance, and located at positions which are convenient for placement of the element although they may not necessarily be convenient for the user. Frequently such additional elements are located at positions other than the ON-OFF main switch itself.

If a single type of motor for a specific type of tool is to be offered to the trade with various types of operating function controls, then it is necessary to provide a multiplicity of switches or switch combinations for the respective tool models of any one series, depending on the desired control function. This increases manufacturing costs and particularly increases storage and procurements costs as well as storage of replacement parts at service stations. The housing of the tool itself may have to be different for different types or models of the same basic series of machine tools in order to accommodate such additional elements which, further, increases the cost of production and hence of the final unit.

It is an object of the present invention to provide a modular switch and control unit construction in which the switch housing and the respective operating control units are so arranged that various desired operating functions can be associated with the respective switch units, or not, as desired for a specific model, without requiring changes in the basic modules being used. Various operating functions can thus be accommodated with a minimum of storage requirement for parts.

SUBJECT MATTER OF THE PRESENT INVENTION

Briefly, the housing unit has a switch therein providing for the main ON-OFF switching function. At least two operating control units are associated with the switch to provide two additional control functions, for example speed control, which may be continuously variable or in ranges, overload protection, with or without reset, forward or reverse rotation, RF interference suppression. The additional operating control units are assembled and secured to the housing by respectively mutually interengaging projection and recess connections, preferably dovetail joints, so that the switch and, selectively, additional control units providing for selectively different additional control functions can be associated with the switch to form a unitary assembly of the switch housing and the two selected control units providing the selected additional control functions. A third additional control unit may also be associated with the switch to provide yet greater selectivity in overall operating functions which the unit can provide. The modular construction of the unit permits selected use with the selectively different operating functions so that the operating functions which have been associated with the basic ON-OFF can be matched to various types of tools or appliances.

The assembled unit can be so designed that the overall dimension of the housing of the basic ON-OFF switch, together with associated control units, is always the same — regardless of the type of control unit selected or, at least, does not exceed a certain maximum dimension. Thus, the space requirement for control of the respective tool or appliance has been standardized. The dimensions of the unit can be made independent of the particular type of control trigger therefor, for example a trigger handle which is combined with a control knob to function as a set knob for a speed control which limits the deflection of the control trigger to a predetermined preset point. The associated electrical network or control components then form one of the control units attached to the switch. Other control units with the mutually interengaging attachment arrangements can be associated with the basic ON-OFF switch, for example two or three speed control levers, rotation direction control levers, diode-speed control circuits, overload circuits or cut-outs and the like. Such units, as well as for example an RF suppression capacitor can readily be associated with the basic ON-OFF switch in its housing.

The modular construction permits provision of switch units having a housing in which the basic module will be identical for the entire series of the tool or appliance with which the switch is to be used, independent of specific models of the tool or appliance. Thus, overall manufacturing storage and production costs can be reduced. Use of a switch of standardized maximum dimension, when associated with the respective control units, permits design of handles or control panels or spaces for the unit of maximum dimension which reduces costs in the manufacture of the housing or handle for the tool or appliance.

DRAWINGS ILLUSTRATING AN EXAMPLE

Figure 1:
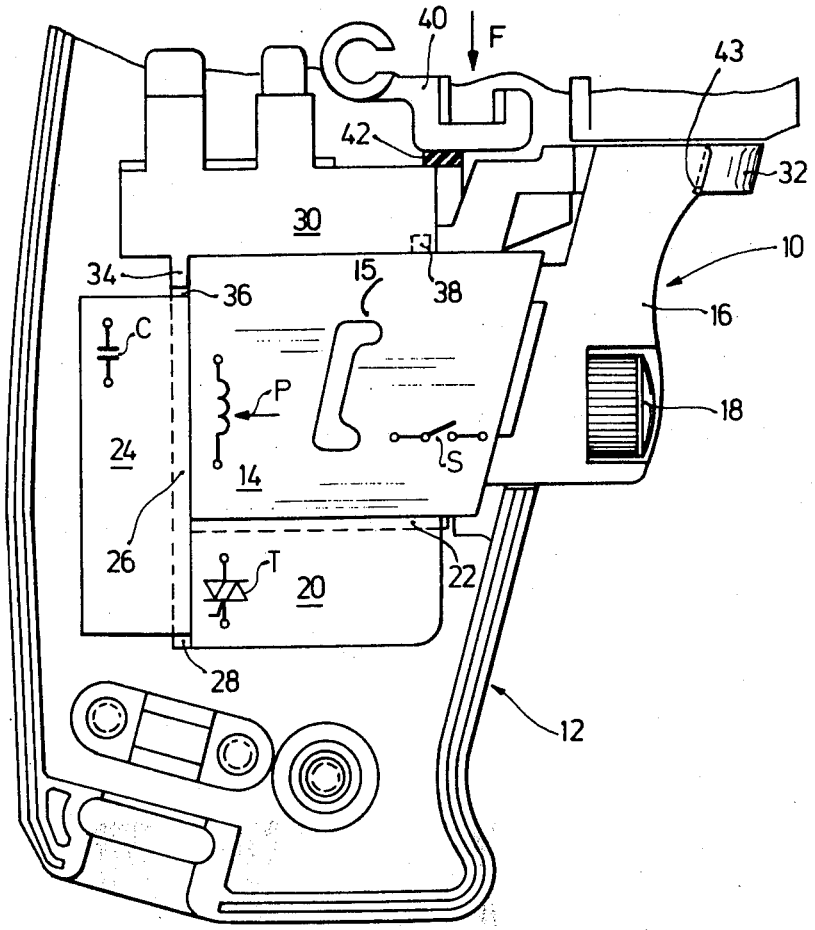
FIG. 1 is a plan view of a switch unit installed in the handle of an electric drill, in which various functions are schematically indicated, with half of the drill handle removed.

A handle 12 of an electric drill has a switch 10 located therein. The invention will be described in connection with an electric drill although, of course, it is equally appropriate for use with other tools or appliances.

The switch unit 10 has a switch housing 14 in which a standard ON-OFF switch S is included, operated by a switch trigger 16. The housing 14 is secured to the handle 12 by means well known, for example by interengaging projection-and-recess means 15 molded or formed on the switch housing 14 and on the handle 12 of the drill. A button 18 is secured to the switch unit 14. Button 18 is used if, in addition to the ON-OFF function of the switch, speed control is desired which is included in a separate circuit element 20 attached to the switch housing 14. This type of speed control is continuously variable in that, upon continuous depression of the trigger 16 of switch 14, the speed increases. The knob 18 limits the extent of depression of the switch 16 and thus determines the final position of the trigger 16 and hence the speed which can be set. If the switch 14 includes a continuously variable speed function, then the trigger 16 operates not only an ON-OFF switch S but, additonally, is coupled to a potentiometer P which controls the timing of firing of a triac T included in the circuit element 20. Other circuits to provide for speed control of the drill can be used.

The electronic unit 20, forming an operating control unit for the drill, is located in a housing which is connected to the housing 14 of the drill by means of a dovetail projection-recess connection 22. It is removably secured to the bottom side of the switch housing 14, although it can be located at other positions. The back side of the switch housing 14, that is, at the left side of FIG. 1, has an RF interference suppression capacitor 24 secured thereto. It is connected to the switch housing 14 by means of a dovetail connection 26. The dovetail connection 26 is schematically shown in FIG. 2. The dovetail connection 26 (see FIG. 2) is connected with the housing 14 by means of a dovetail wedge on the one hand, and a dovetail groove formed on the housing of capacitor 22 on the other. The left, that is the back portion of the housing for electronic unit 20, is formed with a dovetail wedge which is similar to that of the switch housing 14, so that the housing of unit 20 can be connected by an additional dovetail 28 with the RF suppression capacitor 24. This provides for a particularly reliable connection between the two units attached to the housing 14, so that both the unit 20 as well as the unit 24 are securely attached to the switch unit 14.

A further operating control unit 30 is secured to housing 14 of the switch S. That additional unit can include various elements, for example a transfer switch, located in its own switch unit, and formed with a projecting operating lever 32. The housing 30 of the additional unit is formed with downwardly extending projections 34 which define a dovetail groove and which, together with the dovetail wedge 36 at the back side of the housing 14 form a further dovetail connection between the housing 30 of the additional unit and the housing 14 of the ON-OFF switch S. The additional element 30 is further connected to the housing 14 of the switch S by interengaging projection-and-recess means formed as a pin or knob 38 projecting from the upper side of the housing 14 and engaging in a respective notch, groove or hole 39 formed in the housing of the additional unit 30. The additional unit 30 is additionally secured in the drill handle 12 by a resilient holding lever 40 which is resiliently biassed in downward direction as schematically indicated by spring force F. A resilient pad 42, for example of foam plastic or rubber, and located at the opposite end of unit 30 — with respect to the dovetail extension 34 — presses the housing of unit 30 downwardly against the switch housing 14. Housing 14 is a plastic injection molding.

Figure 2:
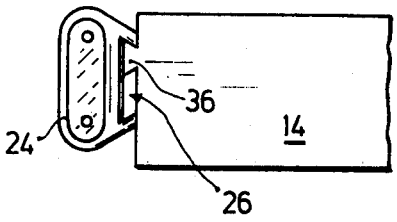
FIG. 2 is a fragmentary top view of the switch unit and an associated RF suppression capacitor, and illustrating a tongue-and-groove connection.

The forward portion of the trigger element 16, that is the right hand portion as seen in FIG. 1, is preferably formed with a break-off panel. This forward portion is shaped to have approximately rectangular configuration, corresponding approximately to the cross-sectional dimensions of the transfer lever 32. The edges of the panel are attached to the trigger 16 by break-off fracture lines 43 so that the panel can be broken out if the unit 30 is formed with an operating handle 32, but can be left if unit 30 does not utilize a manually accessible control lever or the like. The panel can thus be removed, by breaking out, punching or the like, if it is desired to form an opening for the transfer switch lever 32. Thus, the same switch 14 with the same trigger handle 16 can be used, universally, for various types and models of drills, whether or not an additional control lever 32 is needed or required. For example, if the additional operating control unit 30 is a bi-metal switch associated with switch 14 to provide overload protection, the panel could be left intact since no manually accessible control element is needed; alternatively, the switch may be of the manual-reset type requiring accessibility; or, for example, the switch 32 may be used to provide a dual-speed control if continuously variable speed control is not needed; or, unit 30 might provide for reversal of direction of rotation, with lever 32 providing for switch-over from clockwise to counterclockwise rotation, for example.

Figure 3:
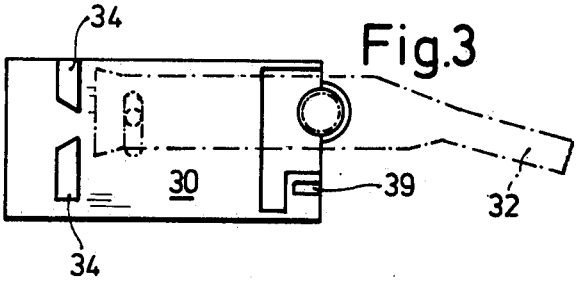
FIG. 3 is a bottom view of a manually accessible changeover or transfer unit and illustrating attachment arrangements to the housing of the switch and to the capacitor.

The various connections between the housing 14 of the switch S and the associated operating control units can be shaped in different ways. Basically, they are interengaging projection-and-recess connections. The conical dovetail connection shown in FIGS. 2 and 3 is simple and ensures a reliable connection and secure seating, while being easy to manufacture and permitting comparatively coarse manufacturing tolerances. They are not critical with respect to accuracy of manufacture. Rather than using dovetail interconnections, however, other releasable and preferably slidable connections can be used. The interconnections can be, for example, by means of pins or resilient flaps which cooperate with suitable counter elements on the other respective unit which is to be attached in order to ensure reliable interconnection. Snap-in connections, for example by a resiliently deformable or slotted pin fitting into a slightly undersized opening, may also be used. One such connection may be, for example, between knob 39 (FIG. 3) and opening 38.

Figure 4:
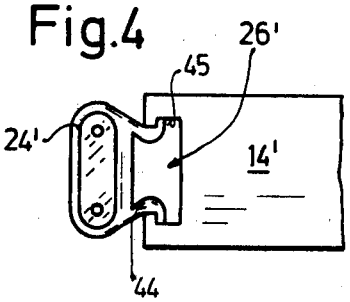
FIGS. 4 and 5 are fragmentary top views illustrating different forms of interengaging attachments of the additional control units, of which a capacitor is shown, to the housing of the switch.
Figure 5:
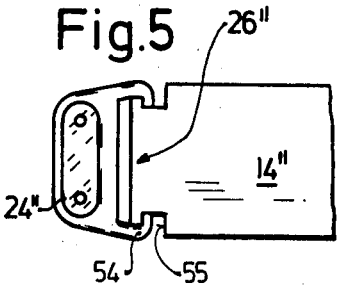

FIG. 4 illustrates a simple and reliable connection for the RF suppression capacitor 24′ to the switch housing 14′. FIG. 5 illustrates the reverse of the connection in which the capacitor 24″ is connected to switch housing 14′. The capacitor 24′, 25″ is formed with angled-off projecting strips 44 which engage in a groove or an overlapping track 45 in housing 14′. FIG. 5 shows the reverse: The housing 24″ of the capacitor is formed with strips 54 having inwardly directed end portions which engage into a groove 55 molded adjacent the back wall of the housing 14'. FIGS. 4 and 5 thus illustrate connections 26', 26'', respectively, which functionally correspond to the dovetail connections 26 shown in FIGS. 1 and 2.

Various changes and modifications may be made, and features described in connection with any one of the embodiments may be used with any one of the others, within the scope of the inventive concept. Particularly, the connection of units 20 and 30 to the housing 14 of the switch S can be similar to that shown in connection with the capacitor 24 in FIG. 2 or with the capacitor 24', 24'' in FIGS. 4 and 5.

The electrical interconnection between the switch unit 14, the capacitor 24, and the electrical units 20 and 30 has not been shown and may be effected by exposed circuit portions adjacent the respective housings, by separate wiring, or by plug-and-socket connections between the switch unit 14 and the respective other units, which can be preformed and molded on the housings of the respective elements or units.

I claim:

1. Multiple function, selectively combinable hand-actuated switching unit structure system, particularly for electrical hand tools, appliances and the like, to provide the functions of (a) ON-OFF, and, selectively, at least two of the functions of (b) speed control;

(c) overload protection;

(d) forward and reverse rotation;

(e) radio interference (RF) interference supression, said switching unit comprising a plurality of functional circuit structure units (20, 24, 30), respectively providing said function (b) to (e);

a separate enclosure for each respective circuit structure unit, each enclosure being formed with at least one attachment surface;

a switch housing unit (14) having an integrated enclosure of, in plan view, essentially rectangular shape and formed with a plurality of attachment surfaces at the sides thereof for selective attachment thereto of selected ones of said structure units;

an ON-OFF switch (S) in said housing unit (14);

and relatively engageable and separable interengaging projection-and-recess means formed on the attachment surfaces at said sides of said switch housing unit and on the attachment surfaces of said functional circuit structure units to assemble and secure a selected one of said functional circuit structure units to the switch housing unit by matching engagment of said respective attachment surfaces and interengagement of said separable projection-and-recess means.

2. Unit according to claim 1, wherein at least one of said projection and recess means comprises a dovetail wedge (36) and complementary dovetail groove means.

3. Unit according to claim 2, wherein the dovetail wedge (36) has longitudinally extending tapered side edges.

4. Unit according to claim 1, wherein at least another one of the interengaging projection and recess means comprises a projecting knob or pin (38) and a complementary recess (39) into which the knob or pin fits.

5. Unit according to claim 4, wherein the knob or pin and recess means comprises a resiliently interengaging snap-in connection.

6. Unit according to claim 2, wherein at least one of the interengaging projection and recess means comprises a projecting pin or bolt-like element (39) formed on one of said units and a recess (39) formed on the other of said units.

7. Unit according to claim 1, wherein at least one of the projection and recess means comprises a resilient springy projecting flap or strip (44, 54) formed on one of the units and a matching recess (45, 55) on an other of said units into which said flap or strip fits.

8. Unit according to claim 1, wherein at least one of the projection and recess means are molded on the housing of said switch housing unit and the respective operating control unit.

9. Unit according to claim 8, wherein the housing of the switch housing unit (14) and of the respective operating control unit comprises an injection molded plastic.

10. Unit according to claim 1, wherein an operating trigger (16) is provided to operate the ON-OFF switch (S);

the operating trigger being formed with a forward wall having an opening therein to provide access for an operating element (32) associated with one of said circuit structure units (30).

11. Unit according to claim 1, wherein an operating trigger (16) is provided to operate the ON-OFF switch (S);

said operating trigger being formed with a forward wall having a weakened portion therein, the weakened portion being defined by break-off lines or scores to permit removal of the panel defined by the weakened portion and to provide access for an operating element (32) associated with one of the units or, selectively, to leave said wall portion if said associated operating control unit does not have an individual operating element.

12. Unit according to claim 1, wherein the second functional circuit structure unit comprises a diode switch.

13. Unit according to claim 1, wherein the second functional circuit structure unit comprises an overload switch.

14. Unit according to claim 1, wherein the second functional circuit structure unit comprises a speed control unit.

15. Unit according to claim 1, wherein the second functional circuit structure unit comprises a rotation-direction changeover switch.

16. Unit according to claim 1, wherein one of said functional circuit structure units comprises an RF interference suppression capacitor (24).

17. Unit according to claim 1 wherein at least one of said interengaging projection-and-recess means comprises extended tongue-and-groove means permitting sliding, interlocking engagement of a respective functional circuit structure unit with said switch housing unit.

18. In a modular switch unit system wherein a switch is provided, having a switch housing (14) having an integrated enclosure which, in plan view, is of essentially rectangular shape, and formed with a plurality of attachment surfaces at the sides thereof, a modular component for assembly with said switch housing unit and forming a functional circuit structure unit providing the function of at least one of: speed control; overload protection; forward and reverse rotation of a motor; radio frequency (RF) interference suppression;

said modular component having an integrated enclosure formed with at least one attachment surface;

an interengaging projection-and-recessed means to releasably, separately connect a modular component to said switch housing unit including an interengaging projection portion and a recessed portion means, respectively, on the attachment surfaces of said switch enclosure and on the attachment surface of said modular unit enclosure, said interengaging means being complementary to each other.

19. Modular component according to claim 18, wherein said one portion is a dovetail groove.

20. Modular component according to claim 18, wherein said one portion is a resilient strip or flap (44, 54) and said other portion forms a ridge, said ridge overlapping said strip or flap.

21. Modular component according to claim 18, wherein said one portion is a resilient strip or flap (44, 54) and said other portion forms a groove (45), said strip or flap being engageable in said groove.

22. Modular component according to claim 18, wherein said one portion is a resilient strip or flat formed with an offset edge portion, and said other portion is formed with an overlapping strip, overlapping said offset edge portion of the resilient flap.

23. Modular component according to claim 18, wherein at least one of said interengaging projection and recess portion means comprises extended tongue-and-groove means permitting sliding, interlocking engagement of two respective units.

* * * * *